US005771618A

United States Patent [19]

Burke et al.

[11] Patent Number: 5,771,618

[45] Date of Patent: Jun. 30, 1998

[54] SAFETY APPARATUS FOR INDICATING THE PRESENCE OF A TRANSLUCENT MEDIUM

[76] Inventors: Eileen M. Burke, 20 Champion St., Merrimac, Mass. 01860; Barbara Gilinsky, 1410 Johnson Ave. Waterview #17, Point Pleasant, N.J. 08742

[21] Appl. No.: 562,732

[22] Filed: Nov. 27, 1995

[51] Int. Cl.[6] ..... G09F 7/04

[52] U.S. Cl. ..... 40/600; 40/621; 248/223.41

[58] Field of Search ..... 40/600, 621; 403/381; 248/223.41, 225.11, 206.5, 467, 683; 24/303

[56] References Cited

U.S. PATENT DOCUMENTS

| | | | |
|---|---|---|---|
| 1,694,639 | 12/1928 | Brown | 40/621 |
| 2,921,388 | 1/1960 | Stefaney | 35/73 |
| 3,464,134 | 9/1969 | Franklin | 40/142 |
| 4,207,697 | 6/1980 | Murphy | 40/621 |
| 4,236,331 | 12/1980 | Mattson | 40/600 |
| 4,242,823 | 1/1981 | Bruno | 40/621 |
| 4,838,793 | 6/1989 | Taylor | 434/168 |
| 4,852,284 | 8/1989 | Faggiano | 40/488 |
| 5,295,342 | 3/1994 | Roche et al. | 52/764 |
| 5,433,416 | 7/1995 | Johnson | 403/381 |

FOREIGN PATENT DOCUMENTS

| | | | |
|---|---|---|---|
| 8607271 | 12/1986 | WIPO | 40/621 |
| 9320548 | 10/1993 | WIPO | 40/600 |

*Primary Examiner*—Cassandra H. Davis
*Attorney, Agent, or Firm*—Louis J. Franco

[57] ABSTRACT

A safety apparatus and method for indicating the presence of a translucent medium comprising a magnetic structure having a removably attachable visible element portion that, when positioned on a translucent medium such as a patio door, screen, window or the like, warns of the presence of the translucent medium so that a person does not inadvertently attempt to walk through the translucent medium thereby risking serious injury or bodily harm.

2 Claims, 5 Drawing Sheets

SAFETY APPARATUS FOR INDICATING THE PRESENCE OF A TRANSLUCENT MEDIUM

FIELD OF THE INVENTION

This invention relates generally to a safety apparatus and method for indicating the presence of a translucent medium, and more particularly to a magnetic structure having a removably attachable visible element portion that, when positioned on a translucent medium such as a patio door screen, window or the like, warns of the presence of the translucent medium so that persons do not inadvertently attempt to walk through the translucent medium thereby risking serious bodily injury and property damage.

BACKGROUND OF THE INVENTION

It is well known that numerous accidents occur in the home and wherever there exist translucent media such as glass or screens. Windows and doors, especially patio doors, are often not discernible, and persons are frequently injured when they walk into or through closed glass or screen doors. Such accidents occur because the clarity or surface texture of these media make them so translucent that persons can not determine whether such doors or windows are open or closed. With the possible exceptions of applying such items as tape, stickers, decals and suction cups to these translucent media, no devices or methods are known for preventing such collisions.

When exposed to ultraviolet light, humidity and, and other weathering effects, tape and stickers eventually lose their adhesive properties regardless of the surfaces to which they are applied. In addition, these items do not adhere well to discontinuous and mesh-like surfaces such as window screens. Also, the effective adhesion of stickers or tape to glass surfaces requires thorough cleaning of the glass prior to adhesion to delay the eventual peeling and curling of these items, which renders them unattractive. Furthermore, stickers and tape are difficult to remove and leave behind messy residues upon removal. Often, harsh, dangerous and volatile solvents must be employed to dissolve and remove these residues. This process can weaken, discolor and damage surfaces such as screens, Plexiglas®, and plastic.

Decals placed on glass present difficulties similar to those presented by the use of stickers and tape, and they can not be readily replaced without scraping the old one off the surface and providing a new decal. Also, decals are somewhat clumsy to install and they peel and frequently crack when exposed to the effects of the weather.

Suction cups do not adhere to screens and, when placed on glass, may dirty and even mar the surface. In addition, the material from which suction cups are constructed degrades, and often discolors, when exposed to ultraviolet light. Furthermore, the variety of surfaces to which suction cups can be adhered is limited; such surfaces must be smooth and substantially planar in the vicinity of the suction cup. A further problem presented by the use of suction cups is that drastic changes in temperature often cause the breaking of the seal on which their adhesion to the surface depends. Also, suction cups are not visually pleasing or decorative.

An alternative and improved means for overcoming the previously mentioned shortcomings of prior devices is to provide a safety apparatus that utilizes a pair of magnetically attractive elements to which easily removable visible elements are attached. The magnetically attractive elements interact with each other through translucent media such as glass, plastic, Plexiglas® and screen. When the safety apparatus is installed on a glass or screen patio door, for example, it warns persons approaching from either direction of the presence of the screen or glass to prevent collisions therewith.

Other applications for the safety apparatus herein described include signage, nameplate guides for offices, businesses and schools as well as advertisements. These applications and others noted above preferably require a convenient apparatus that is relatively simple to utilize and manufacture. The prior art has attempted to provide a limited number of related indicator devices for a variety of applications, several of which are discussed below. However, no device for indicating the presence of a translucent medium similar to the instant invention has been found to exist.

U.S. Pat. No. 4,242,823 to Bruno shows a magnetically attractive mesh screen having removably attachable indicia characters. U.S. Pat. No. 2,921,388 to Stefaney shows a wire mesh screen of ferromagnetic material such as iron having magnetic shapes attached thereto. U.S. Pat. No. 5,295,342 to Roche shows a display panel having dual securement means. A ferromagnetic apertured material, preferably a wire mesh is used to receive magnetic means and a penetrating object such as a tack for securing a displayed item to the display panel.

U.S. Pat. No. 4,838,793 to Taylor shows an activity display article with magnetically removable manipulatives. A magnetic strip is mounted on a back of an activity sheet for holding paper sheets to a ferrous base. Also, U.S. Pat. No. 3,464,134 to Franklin shows a magnetic display with magnetically removable display members for detachably securing on a magnetized surface. Such devices necessarily rely upon mesh screen and bases made from ferromagnetic material for attachment of indicia characters and various magnetic display manipulatives.

U.S. Pat. No. 4,852,284 to Faggiano shows a glass mountable sign. A base panel is mounted to glass with metal strips and magnets.

Accordingly, there is a great need for an inexpensive device that can conveniently and practically indicate the presence of a translucent medium. Such a device therefore is preferably manufactured at a low cost and simple to assemble and use.

SUMMARY OF INVENTION

It is therefore an object of the present invention to provide an apparatus that is simple in design, inexpensive, easy to manufacture and simple to use for indicating the presence of a translucent medium to reduce the potential for bodily injury and structural damage.

It is also an object of the present invention to provide a method for indicating the presence of a translucent medium to reduce the potential for bodily injury and structural damage.

It is a further object of the present invention to provide an apparatus that is easy to install, remove, and reposition without destruction of the apparatus or damage to the surface from which it is removed.

It is also an object of the present invention to provide an apparatus that, when removed from a location on the translucent medium, leaves behind no sticky, difficult-to-remove residue.

It is a further object of the present invention to provide an apparatus that, when installed, will remain in position until removal or relocation of the apparatus is desired.

A further object of the present invention is to provide a safety apparatus that has magnetically attractive elements for magnetic attraction through a translucent medium.

It is a further object of the present invention to provide aesthetically pleasing visible elements for removably attaching to the magnetically attractive elements.

A further object of the invention is to provide a means for removably attaching, removing, and interchanging the visible elements to the magnetically attractive elements for warning persons approaching the translucent medium from either side.

This invention results from the realization that there is a great need for an efficient, convenient, practical, low cost and versatile safety apparatus and method for indicating the presence of a translucent medium. The resulting indicating apparatus alerts a person to the presence of a closed translucent door, window, screen or other translucent medium. Since the visible elements are readily interchangeable, the apparatus lends itself to the display of an infinite number of signs, nameplates, advertisements, seasonal decorations, ornaments, and other indicia.

The above and other objects are achieved in accordance with the present invention which, according to a first aspect, provides a safety apparatus for indicating the presence of a translucent medium comprising a first magnetic element and a second magnetic element juxtaposed to each other for magnetic attraction through the translucent medium, each magnetic element having an inner face and an outer face, a visible element and a means for removably attaching each visible element to the outer face of each of the magnetic elements.

According to a second aspect of the invention, an apparatus for warning of the presence of a translucent medium is disclosed that is similar to that disclosed in the first aspect of this invention. The warning apparatus includes a first magnetic element having an inner face and an outer face and a second magnetic element having an inner face and an outer face. The inner face of the second magnetic element is juxtaposed to the inner face of the first magnetic element for magnetic attraction to the inner face of the first magnetic element through the translucent medium. A visible element is fixedly attached to at least one of the outer face of the first magnetic element and the outer face of the second magnetic element. The means for removably attaching the visible elements to the outer face of each magnetic element includes a first interlocking member with a tongue having a perpendicularly extending flange and a second interlocking member having a channel with a groove therethrough for receiving and retaining the tongue and flange respectively of the first interlocking member.

According to a third aspect of the invention, a method of warning of the presence of a translucent medium is disclosed. A first magnetic element and a second magnetic element are provided, each having an inner face and an outer face. The inner faces of the two magnetic elements are juxtaposed to each other for magnetic attraction through the translucent medium. Visible elements and a means for removably attaching the visible elements to the outer faces of the first and second magnetic elements are provided. The visible elements are then removably attached to the outer surfaces of each of the magnetic elements for displaying.

BRIEF DESCRIPTION OF THE DRAWINGS

Other objects, features, and advantages of this invention will occur to those skilled in the art from the following description of a preferred embodiment and the accompanying drawings, in which:

Referring now to the drawings and in particular to FIG. 1, there is shown a side edge view of the preferred embodiment of the safety apparatus for indicating the presence of a translucent medium.

FIG. 3 is a view of the attaching means shown in FIG. 2 which has been inverted horizontally and vertically to reveal elements obscured by the perspective of FIG. 2.

DISCLOSURE OF THE PREFERRED EMBODIMENT

Figure 1:
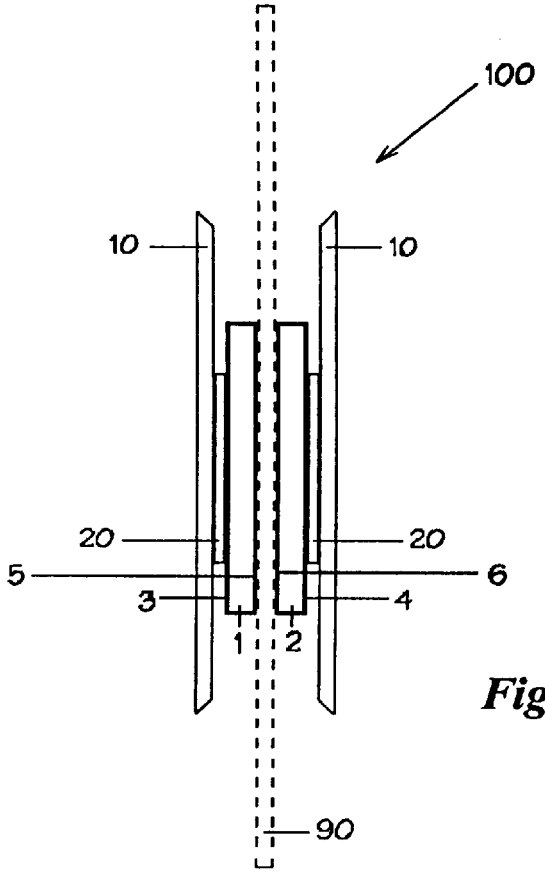

There is shown in FIG. 1 a safety apparatus 100 according to a preferred embodiment of the present invention. Safety apparatus 100 comprises a first magnetic element 1, a second magnetic element 2, visible elements 10 and attaching means 20 for removably attaching each of magnetic elements 1 and 2 to a single visible element 10. First magnetic element 1 is preferably a permanent magnet and second magnetic element 2 is preferably a permanent magnet. Alternatively, one of magnetic elements 1 and 2 is a permanent magnet and the other magnetic element is made from a ferromagnetic material to produce a similar mutual attraction effect as when both magnetic elements 1 and 2 are permanent magnets.

When safety apparatus 100 is in use, inner faces 5 and 6 of magnetic elements 1 and 2 respectively are mounted in mutual alignment on opposite sides of translucent medium 90. Inner faces 5 and 6 of magnetic elements 1 and 2 respectively must be of opposite magnetic polarities so that the desired mutual attraction effect is achieved; the magnetic attraction force between magnetic elements 1 and 2 must be of sufficient magnitude to support the weight of safety apparatus 100 in the desired position on translucent medium 90. The installation and use of safety apparatus 100 is accomplished by mounting inner faces 5 and 6 of magnetic elements 1 and 2 respectively on opposite sides of translucent medium 90, then, once magnetic elements 1 and 2 are secured in their desired positions by their mutual magnetic attraction, with translucent medium 90 sandwiched between them, removably attaching visible elements 10 to the outer faces 3 and 4 of magnetic elements 1 and 2 respectively. The visible elements 10 can be, for example, of particular designs such as shamrocks, Christmas trees or any other chosen design, character or scene. Preferably, visible elements 10 are made by plastic injection molding, although other materials such as ceramic, wood, metal, cardboard, paper, fiber, rubber and cloth can be dimensionally configured into a wide variety of two and three dimensional shapes and sizes to create visible elements 10. Also, characters or other indica may be included on visible elements 10 when safety apparatus 100 is used as a sign, for example. Although not necessary, visible elements 10 can be further enhanced by use of luminous paint, mirrors, lights, string and other surface embellishments including three dimensional contours. Visible elements 10 are removably attached to outer face 3 of magnetic element 1 and outer face 4 of magnetic element 2 using attaching means 20. Translucent medium 90 is sandwiched between magnetic element 1 and magnetic element 2 by aligning inner face 5 of magnetic element 1 with inner face 6 of magnetic element 2 such that the magnetic elements 1 and 2 are aligned with one another on opposite sides of translucent medium 90. When safety apparatus 100 is installed on a glass or screen patio door, for example, it warns in both directions of the presence of the screen or glass so that persons will not accidentally attempt to walk through that screen or glass. Being adaptable to display a wide variety of seasonal scenes or the like, safety apparatus 100 is not only highly functional as a safety device, it is also decorative. Similarly, safety apparatus 100 can be utilized to display signs, nameplate guides, advertisements as well as other related items for offices, businesses and schools in addition to helping prevent persons from walking through translucent media.

Figure 2:
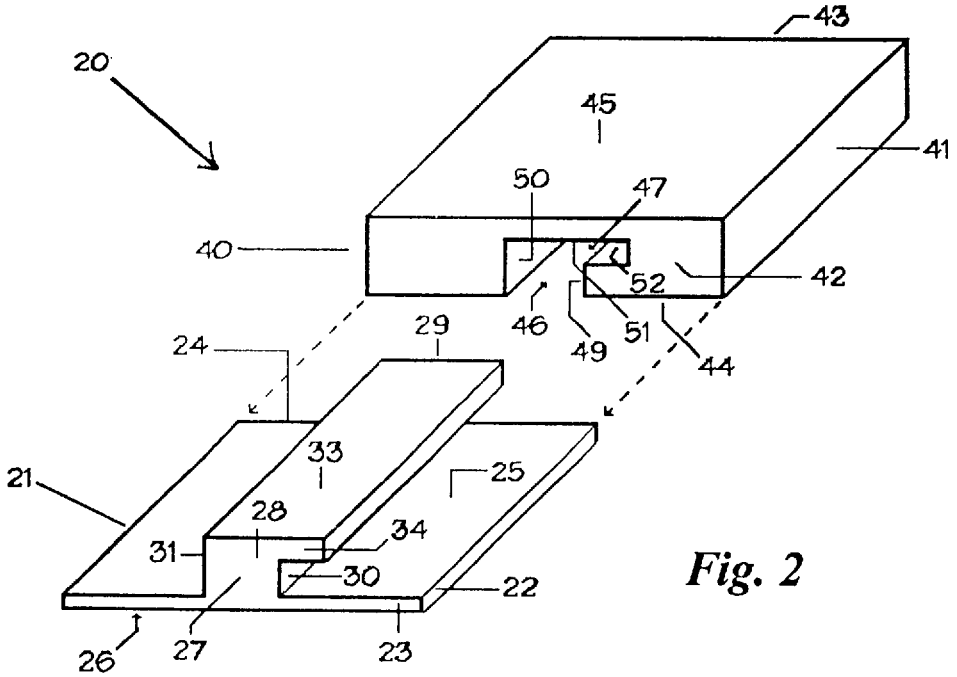
FIG. 2 shows a perspective view of the attaching means of a preferred embodiment of the safety apparatus.

FIG. 2 shows a perspective view of the means for removably attaching 20 visible elements 10 to the outer faces 3 and 4 of magnetic elements 1 and 2 respectively for the preferred embodiment of safety apparatus 100. Referring to FIG. 2, attaching means 20 preferably comprises a first interlocking member 21 and a second interlocking member 40. First interlocking member 21 has a base 22 having a first end 23 and a second end 24. Base 22 further has an inner face 25 and an outer face 26. A tongue element 27 extends longitudinally along inner face 25 of base 22 and is perpendicular thereto. Tongue element 27 has a first end 28, a second end 29, a first edge 30, a second edge 31, an upper surface 33, and a flange 34. Although first interlocking member 21 preferably has a flat base having a tongue portion with an "L" shaped cross-section, other configurations can be used without departing from the intent and scope of this disclosure. For example, a flat base can have a tongue portion that is "T" shaped, "V" shaped, "dovetail" shaped or tapered. Furthermore, the base portion can be round, square, rectangular and can also have a curved surface. The base 22 and the tongue element 27 of first interlocking member 21 are preferably integrally molded from plastic, but base 22 and tongue element 27 may be fabricated separately and fixedly attached to one another. Furthermore, whether the base 22 and the tongue element 27 are integrally molded or fabricated separately, they can be fabricated from a variety of materials such as ceramic, wood, metal, cardboard, paper, fiber, and rubber, as alternatives to the preferred plastic construction.

To further describe attaching means 20, again referring to FIG. 2, second interlocking member 40 has a housing 41 having a first end 42, a second end 43, an inner face 44 and an outer face 45. A channel 46 extends along inner face 44 of housing 41. Channel 46 has a first end 47, a second end 48 (not shown in FIG. 2, see FIG. 3), a first side 49, a second side 50, a wall 51 and a groove 52. Although second interlocking member 40 is preferably a substantially rectangular solid having an "L" shaped channel portion and groove as shown in FIG. 2, other configurations can be used without departing from the intent and scope of this disclosure. For example, a solid housing can have a channel and grooves that are "T" shaped, or a channel that is "V" shaped, "dovetail" shaped or tapered. Furthermore, the solid housing can be round, square, rectangular and can be curved. While housing 41 is preferably molded from plastic, other materials such as ceramic, wood, metal, cardboard, paper, fiber, and rubber could also be utilized.

The attaching means 20 as disclosed in the preferred embodiment is utilized in the manner described as follows. Visible element 10 (not shown in FIG. 2) is fixedly attached to outer face 26 of base 22 of first interlocking member 21. Outer faces 3 and 4 of magnetic elements 1 and 2 respectively (not shown in FIG. 2) are each fixedly attached to outer face 45 of a second interlocking member 40.

To utilize attaching means 20, first interlocking member 21 is slidably positioned in locking mating relationship with second interlocking member 40 which is designed and fabricated to receive first interlocking member 21. This is accomplished by sliding second end 29 of tongue element 27 of first interlocking member 21 into first end 47 of channel 46 in housing 41 of second interlocking member 40 so that upper surface 33, first edge 30, and second edge 31 of tongue element 27, and inner face 25 of base 22 sidably contact wall 51, first side 49, second side 50 of channel 46 and inner face 44 of housing 41 respectively. In addition, flange 34 of tongue element 27 is accommodated by, and in slidable contact with, groove 52 of channel 46. Furthermore, to prevent first interlocking member 21 from extending beyond second end 43 of housing 41 of second interlocking member 40, a second end 48 (see FIG. 3) of channel 46 is closed and serves as a stop. The attaching means 20 disclosed herein results in first interlocking member 21 being slidably positioned in locking mating relationship with second interlocking member 40 forming an assembly that has outer face 26 of base 22 of first interlocking member 21 and outer face 45 of housing 41 of second interlocking member 40.

In use, when safety apparatus 100 is placed onto a translucent medium 90, visible element 10 can be readily changed without damaging the translucent medium 90 and another visible element 10 having its own first interlocking member 21 fixedly attached thereto can be quickly installed in its place. For example, a seasonal scene such as a Christmas tree design can be easily changed from a Thanksgiving scene or design.

Figure 3:
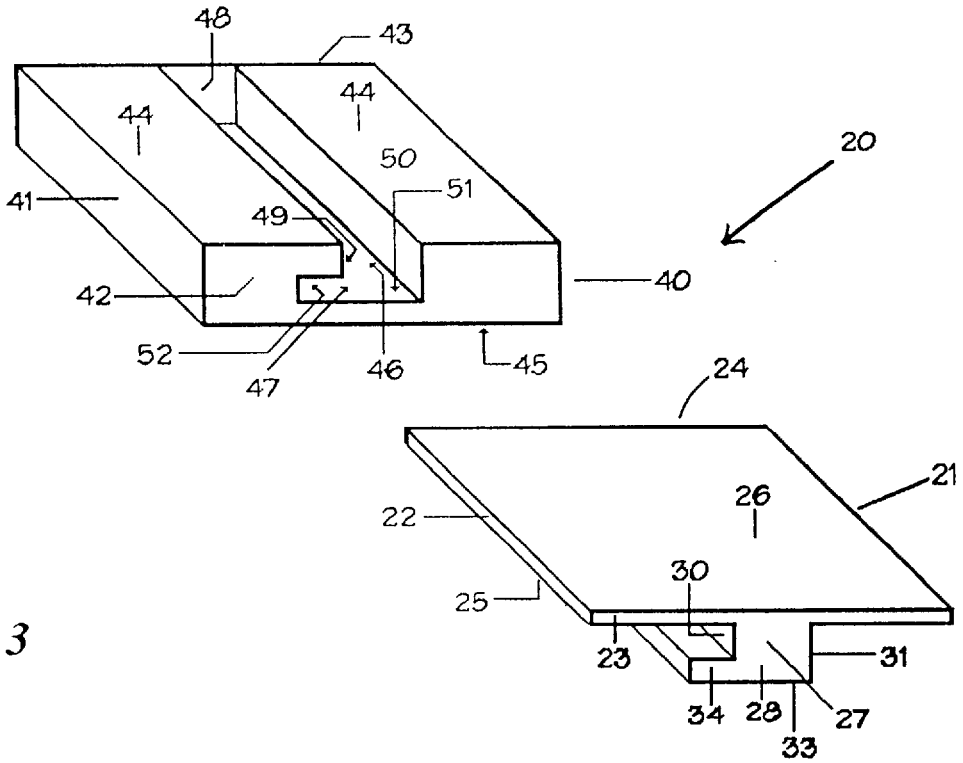
FIG. 3 shows a perspective view of the attaching means of a preferred embodiment of the safety apparatus.

FIG. 3 shows a perspective view of the means for removably attaching 20 visible elements 10 to the outer faces 3 and 4 of magnetic elements 1 and 2 respectively for the preferred embodiment of the safety apparatus 100. FIG. 3 is a view of the attaching means 20 shown in FIG. 2 which has been inverted horizontally and vertically to reveal elements obscured by the perspective of FIG. 2. Referring to FIG. 3, additional details of the means for removably attaching 20 obstructed in FIG. 2, such as second end 48 of channel 46 in housing 41 of second interlocking member 40 are illustrated.

Figure 4:
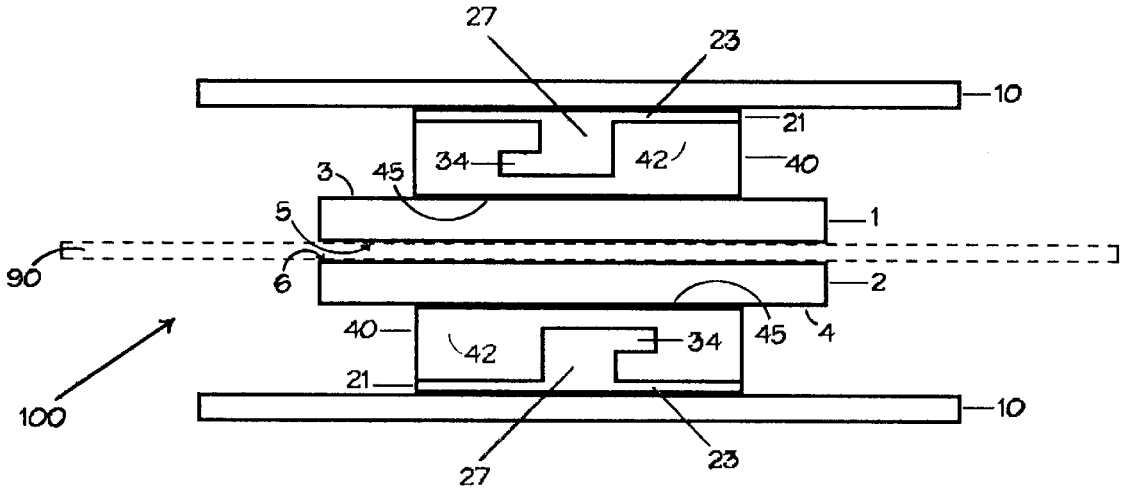
FIG. 4 shows a top edge view of a preferred embodiment of the safety apparatus as it would appear in use on the translucent medium.

FIG. 4 shows a top-side view of a preferred embodiment of safety apparatus 100. As previously discussed, each visible element 10 is fixedly attached to the outer face 26 of a first interlocking member 21. Each first interlocking member 21 is then slidably positioned in locking mating relationship with as many second interlocking members 40. The outer faces 3 and 4 of magnetic elements 1 and 2 respectively are each fixedly attached to the outer face 45 of a second interlocking member 40. The inner faces 5 and 6 of magnetic elements 1 and 2 respectively are placed on opposite sides of translucent medium 90 so that visible elements 10 can be viewed from either side of translucent medium 90 to serve as a warning to prevent persons from inadvertently walking into or through translucent medium 90.

Figure 5:
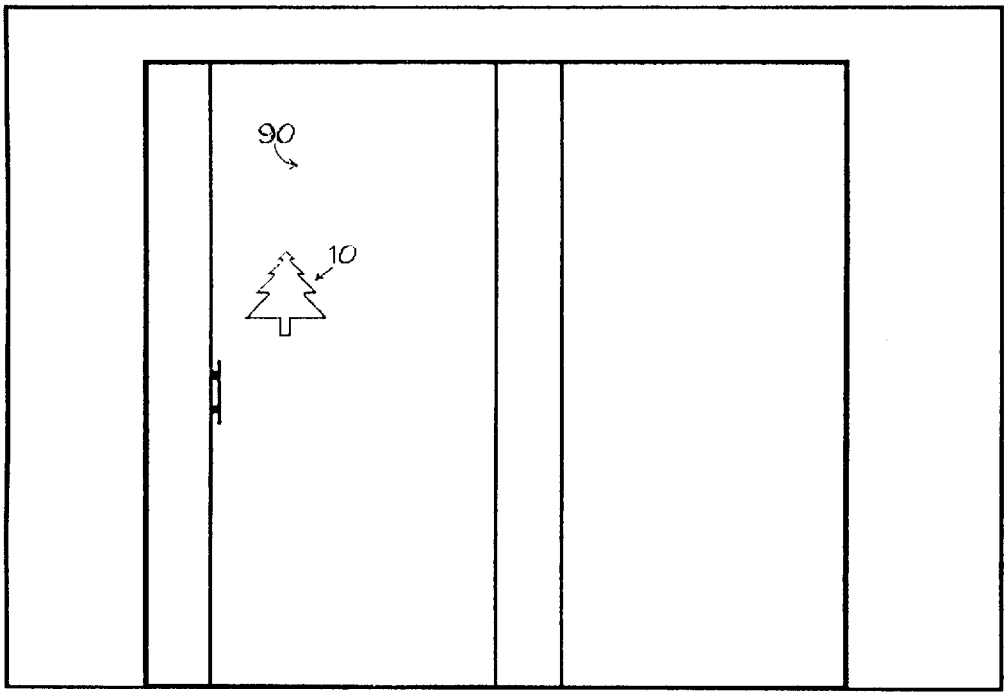
FIG. 5 shows a front view of the safety apparatus as installed on a translucent patio door.

FIG. 5 shows a front view of safety apparatus 100 displaying a visible element 10 as installed on a translucent patio door. Only the visible element 10 is visible from this perspective because the remaining elements of safety apparatus 100 are obstructed by visible element 10. However, the figure demonstrates one of the environments in which safety apparatus 100 is intended to be used.

One practical advantage of safety apparatus 100 is that it helps to prevent personal injury and structural damage to translucent media such as glass and screen patio doors. Being inexpensive to manufacture, safety apparatus 100 lends itself to a wide range of applications utilizing scenes, designs and indicia. For example, a large variety of seasonably changeable scenes and designs are readily adaptable to the instant invention thereby making an attractive enhancement to a translucent medium. Further, the addition of indicia makes the safety apparatus of the invention more versatile and marketable as a sign or advertisement.

Although specific features of this invention are shown in some drawings and not others, this is for convenience only, as some features may be combined with any or all of the other features in accordance with this invention.

The foregoing is considered as illustrative only of the principles of the invention. Furthermore, since numerous modifications and changes will readily occur to those skilled in the art, it is not desired that the foregoing limit the invention to the exact construction and operation shown and described. For example, the means for removably attaching 20 visible elements 10 could comprise a fastener assembly having a plurality of cooperating hooks and loops; magnets; snaps; or any other means for removably attaching two components. Furthermore, it is not essential that the visible elements 10 even be removable; they can be fixedly attached to the outer faces 3 and 4 of magnetic elements 1 and 2 by some means such as glue. Accordingly, all suitable modifications and equivalents may be resorted to that appropriately fall within the scope of the invention. Other embodiments therefore will occur to those skilled in the art and are within the scope of the following claims:

What is claimed is:

1. A safety apparatus for indicating the presence of a translucent medium comprising:

a first magnetic element having an inner face and an outer face;

a translucent medium;

a second magnetic element having an inner face and an outer face, said inner face of said second magnetic element being juxtaposed to said inner face of said first magnetic element for magnetic attraction to said inner face of said first magnetic element through said translucent medium, each of said first and said second magnetic elements being a permanent magnet;

a visible element, and means for removably attaching said visible element to at least one of said outer face of said first magnetic element and said outer face of said second magnetic element comprising a first interlocking member having a base with an outer face and an inner face, said outer face of said base for fixedly attaching to one of said at least one said first and second magnetic element to said visible element, said inner face of said base including a tongue element fixedly attached thereto, said tongue element having a flange extending perpendicularly therefrom, and a second interlocking member comprising a housing with an outer face and inner face, said outer face of said housing for fixedly attaching to the of said at least one said first and second magnetic element to said visible element, said inner face of said housing having a channel extending therein, said channel being open to receive said tongue element of said first interlocking member and having a groove therein for receiving said flange of said tongue element.

2. A safety apparatus for indicating the presence of a translucent medium comprising:

a first magnetic element having an inner face and an outer face;

a translucent medium;

a second magnetic element having an inner face and an outer face, said inner face of said second magnetic element being juxtataposed to said inner face of said first magnetic element for magnetic attraction to said inner face of said first magnetic element through said translucent medium, one of said first and said second magnetic elements being a permanent magnet and the other of said first and said second magnetic elements being a ferromagnetic material;

a visible element; and means for removably attaching said visible element to at least one of said outer face of said first magnetic element and said outer face of said second magnetic element comprising a first interlocking member having a base with an outer face and an inner face, said outer face of said base for fixedly attaching to one of said at least one said first and second magnetic element to said visible element, said inner face of said base including a tongue element fixedly attached thereto, said tongue element having a flange extending perpendicularly therefrom, and a second interlocking member comprising a housing with an outer face and inner face, said outer face of said housing for fixedly attaching to the of said at least one said first and second a magnetic element to said visible element, said inner face of said housing having a channel extending therein, said channel being open to receive said tongue element of said first interlocking member and having a groove therein for receiving said flange of said tongue element.

* * * * *